US006178631B1

(12) United States Patent
Tanabe et al.

(10) Patent No.: US 6,178,631 B1
(45) Date of Patent: Jan. 30, 2001

(54) METHOD OF HEATING AND QUENCHING A HOLLOW METAL MEMBER

(75) Inventors: Shin Tanabe, Sakai; Daisuke Sugimura, Izumi, both of (JP)

(73) Assignee: Shimano, Inc., Osaka (JP)

( * ) Notice: Under 35 U.S.C. 154(b), the term of this patent shall be extended for 0 days.

(21) Appl. No.: 09/239,924

(22) Filed: Jan. 28, 1999

(51) Int. Cl.[7] ..... H01Q 43/00
(52) U.S. Cl. ..... 29/857; 74/594.1
(58) Field of Search ..... 29/857, 423, 825; 74/594.1

(56) References Cited

U.S. PATENT DOCUMENTS

| | | | | |
|---|---|---|---|---|
| D. 29,521 | * | 10/1898 | Metz . | |
| 1,644,157 | * | 10/1927 | Smith . | |
| 2,628,417 | | 2/1953 | Peyches . | |
| 3,555,935 | * | 1/1971 | Dorrenberg . | |
| 3,576,065 | * | 4/1971 | Frazier | 29/402 |
| 3,591,915 | * | 7/1971 | Roberts | 29/402.5 |
| 3,613,766 | * | 10/1971 | Holzi | 164/46 |
| 4,020,543 | * | 5/1977 | Pennings | 29/423 |
| 4,123,769 | * | 10/1978 | Fernandez et al. | 354/322 |
| 4,203,257 | * | 5/1980 | Jamison et al. | 51/2 R |
| 4,226,916 | * | 10/1980 | Schulz et al. | 428/542 |
| 4,297,139 | * | 10/1981 | Beall et al. | 501/2 |
| 4,509,543 | * | 4/1985 | Livingston et al. | 134/57 D |
| 4,586,226 | * | 5/1986 | Fakler et al. | 29/157 R |
| 4,734,307 | * | 3/1988 | Thorsrud | 428/90 |
| 5,010,785 | * | 4/1991 | Romero | 74/594.1 |
| 5,179,873 | * | 1/1993 | Girvin | 74/594.1 |
| 5,197,353 | * | 3/1993 | Trenerry et al. | 74/594.1 |
| 5,226,379 | * | 7/1993 | Everett | 112/262.1 |
| 5,426,997 | * | 6/1995 | Brion | 74/594.1 |
| 5,435,869 | * | 7/1995 | Christensen | 156/175 |
| 5,623,856 | * | 4/1997 | Durham | 74/594.1 |
| 5,791,202 | * | 8/1998 | Karsdon | 74/594.1 |

OTHER PUBLICATIONS

Patent Abstracts of Japan; vol. 010, No. 333, dated Nov. 12, 1986 for JP 61–137634, published Jun. 25, 1986.
Patent Abstracts of Japan; vol. 012, No. 400, dated Oct. 24, 1988 for JP 63–144827, published Jun. 17, 1988.

* cited by examiner

*Primary Examiner*—Carl J. Arbes
(74) *Attorney, Agent, or Firm*—James A. Deland

(57) ABSTRACT

A method of manufacturing a metal member includes the steps of forming a metal body having a hollow core, wherein a side of the metal body defines a core opening exposing the hollow core; placing a filament through the core opening into the hollow core; closing the core opening around the filament; and heating the metal body so that the filament disintegrates to form a filament hole sufficient to allow gas within the hollow core to escape through the filament hole.

16 Claims, 1 Drawing Sheet

METHOD OF HEATING AND QUENCHING A HOLLOW METAL MEMBER

BACKGROUND OF THE INVENTION

The present invention is directed to methods of manufacturing metal structures and, more particularly, to a method of heating and quenching a hollow metal member such as a bicycle crank arm during a manufacturing process.

Bicycle crank arms and other metal structures are often manufactured using a forging process wherein the crank arm is heated and quenched to strengthen the crank arm after a forging step. Problems arise when the heating and quenching steps are performed on hollow crank arms. More specifically, when a crank arm having a fully enclosed hollow space is heated, the air or other gas in the hollow space expands to a high pressure, thus causing deformation of the crank arm. One solution to this problem is to drill a hole on the side of the crank arm body to allow the gas to escape during the heating process. However, this requires an extra machining step, and the hole often allows the quenching liquid to enter the hollow space. The liquid in the space is difficult to remove easily and effectively, and it may cause future corrosion or oxidation. A cap or cover could be placed over the hole before the quenching step, but that would add additional steps, complexity and parts to the manufacturing process.

SUMMARY OF THE INVENTION

The present invention is directed to a method of heating and quenching a hollow metal member such as a bicycle crank arm, wherein an opening may be easily formed to allow gas to escape during heating of the hollow metal member. The hole also may be small enough to inhibit liquid entry during a later quenching step.

In one embodiment of the present invention, a method of manufacturing a metal member includes the steps of forming a metal body having a hollow core, wherein a side of the metal body defines a core opening exposing the hollow core; placing a filament through the core opening into the hollow core; closing the core opening around the filament; and heating the metal body so that the filament disintegrates to form a filament hole sufficient to allow gas within the hollow core to escape through the filament hole. As noted above, this method has particular usefulness when manufacturing a bicycle crank arm. If a filament such as a thin cotton thread is used, then the resulting hole will be large enough to allow gas to escape during the heating process while minimizing or preventing liquid entry during a subsequent quenching step.

DETAILED DESCRIPTION OF THE EMBODIMENTS

Figure 1:
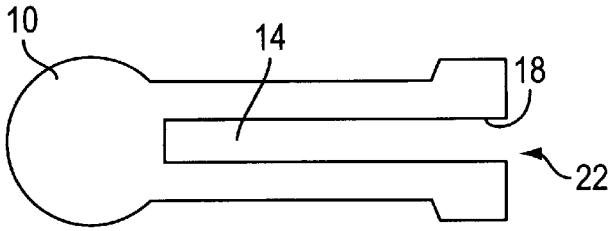
FIG. 1 is a cross-sectional diagram of a bicycle crank arm body at an intermediate step of the manufacturing process.
Figure 2:
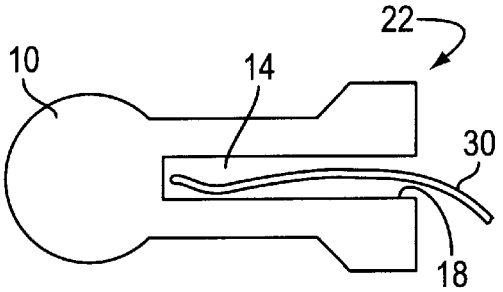
FIG. 2 is a cross-sectional diagram of the bicycle crank arm body with a filament extending through a hollow interior core.

FIG. 1 is a cross-sectional diagram of a metal body such as a bicycle crank arm body 10 that is to be heated and/or quenched in a subsequent process step. Crank arm body 10 may be formed by cold forging in such a way as to provide a hollow core 14, wherein a side or end 22 of the crank arm body 10 defines a core opening 18 exposing the hollow core 14. Thereafter, as shown in FIG. 2, a filament 30 is placed through the core opening 18 such that filament 30 extends into the hollow core 14. Filament 30 may be any thin elongated structure such as a ribbon, wire, elongated cylinder, etc. that substantially disintegrates when exposed to the heat applied during a subsequent process step described below. In this embodiment, filament 30 is a fibrous thread such as a cotton thread having a diameter of from approximately 0.4 millimeters to approximately 3.0 millimeters, e.g., 1 millimeter.

Figure 3:
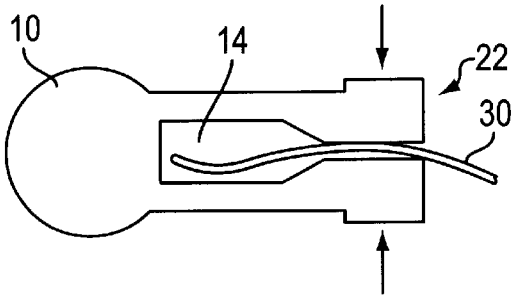
FIG. 3 is a cross-sectional diagram of the bicycle crank arm body showing an end of the crank arm body closed around the filament.
Figure 4:
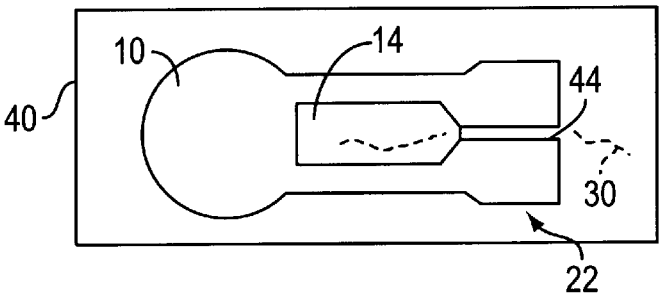
FIG. 4 is a cross-sectional diagram of the bicycle crank arm body during a heating step.

As shown in FIG. 3, the end 22 of crank arm body 10 is closed around filament 30 by pressing or some other well known method. Thereafter, as shown in FIG. 4, crank arm body 10 is placed in a heating vessel 40 and heated to a temperature of from approximately 200° C. to approximately 800° C. In this embodiment, crank arm body 10 is formed from an aluminum alloy, and the crank arm body 10 is heated above 500° C. (e.g., 530° C.). Of course, the temperature depends upon the type of metal member being fabricated and the material used for filament 30. Filament 30 should be made from a material that disintegrates (e.g., melts or burns away) sufficiently at the chosen temperature to form a filament hole 44 that allows gas within hollow core 14 to escape through the filament hole 44 during the heating process. This prevents deformation of the crank arm body 10 due to excessive pressure within hollow core 14 during the heating process. Of course, it is not necessary for the filament 30 to completely disappear as long as it disintegrates sufficiently to allow the gas to escape during the heating process.

Figure 5:
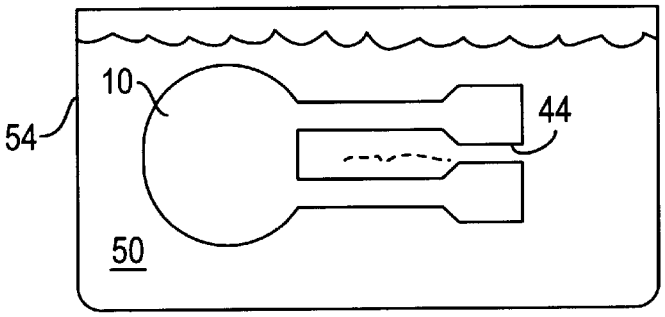
FIG. 5 is a cross-sectional diagram of the bicycle crank arm body during a quenching step.

Thereafter, as shown in FIG. 5, crank arm body 10 optionally may be placed in a liquid 50 such as water in a quenching tank 54 to perform a conventional quenching step to strengthen the crank arm body 10. If it is known that the quenching step is to be performed, then the diameter of filament 30 should be chosen such that filament hole 44 is sufficiently small given the viscosity of liquid 50 to minimize or prevent liquid 50 from entering hollow core 14.

While the above is a description of various embodiments of the present invention, further modifications may be employed without departing from the spirit and scope of the present invention. For example, the functions of one step may be performed by two, and vice versa. It is not necessary for all advantages to be present in a particular embodiment of the process at the same time. Every feature or step which is unique from the prior art, alone or in combination with other features or steps, also should be considered a separate description of further inventions by the applicant, including the structural and/or functional concepts embodied by such feature(s). Thus, the scope of the invention should not be limited by the specific structures disclosed or the apparent initial focus on a particular structure or feature.

What is claimed is:

1. A method of manufacturing a metal member comprising the steps of:

forming a metal body having a hollow core, wherein a side of the metal body defines a core opening exposing the hollow core;

placing a filament through the core opening into the hollow core without completely filling the hollow core;

closing the core opening around the filament; and heating the metal body so that the filament disintegrates to form a filament hole sufficient to allow gas within the hollow core to escape through the filament hole to thereby prevent deformation of the metal body.

2. A method of manufacturing a metal bicycle crank arm comprising the steps of:

forming a crank arm body having a hollow core, wherein a side of the crank arm body defines a core opening exposing the hollow core;

placing a filament through the core opening into the hollow core;

closing the core opening around the filament; and heating the crank arm body so that the filament disintegrates to form a filament hole sufficient to allow gas within the hollow core to escape through the filament hole.

3. The method according to claim 2 wherein the placing step comprises the step of placing a thread through the core opening into the hollow core.

4. The method according to claim 3 wherein the placing step further comprises the step of placing a thread having a diameter of between approximately 0.4 millimeters and approximately 3.0 millimeters through the core opening into the hollow core.

5. The method according to claim 4 wherein the placing step further comprises the step of placing a thread having a diameter of approximately 1.0 millimeter through the core opening into the hollow core.

6. The method according to claim 3 wherein the placing step further comprises the step of placing a fibrous thread through the core opening into the hollow core.

7. The method according to claim 6 wherein the placing step further comprises the step of placing a cotton thread through the core opening into the hollow core.

8. The method according to claim 2 wherein the heating step comprises the step of heating the crank arm body to a temperature above 200° C.

9. The method according to claim 8 wherein the heating step comprises the step of heating the crank arm body to a temperature between approximately 200° C. and 800° C.

10. The method according to claim 8 wherein the heating step comprises the step of heating the crank arm body to a temperature above 500° C.

11. The method according to claim 10 wherein the heating step comprises the step of heating the crank arm body to a temperature of approximately 530° C.

12. The method according to claim 2 further comprising the step of placing the crank arm body in a liquid after the heating step.

13. The method according to claim 12 wherein the step of placing the crank arm body in a liquid comprises the step of placing the crank arm body in water.

14. The method according to claim 2 wherein the step of forming the crank arm body comprises the step of forming an aluminum alloy crank arm body.

15. The method according to claim 14 wherein the heating step comprises the step of heating the crank arm body to a temperature above 500° C.

16. The method according to claim 15 wherein the heating step comprises the step of heating the crank arm body to a temperature of approximately 530° C.

* * * * *